United States Patent [19]

Yamaguchi et al.

[11] 4,436,505

[45] Mar. 13, 1984

[54] DEVICE FOR DETECTING FLAME IN OPEN-TYPE COMBUSTOR AND OXYGEN DENSITY OF INDOOR AIR

[75] Inventors: Hiroshi Yamaguchi; Nobumasa Negishi, both of Gunma, Japan

[73] Assignee: Mitsubishi Denki Kabushiki Kaisha, Tokyo, Japan

[21] Appl. No.: 277,505

[22] Filed: Jun. 26, 1981

[30] Foreign Application Priority Data

Jul. 1, 1980 [JP] Japan ..... 55-89475

[51] Int. Cl.[3] ..... F23N 5/24

[52] U.S. Cl. ..... 431/76; 431/37; 431/208; 328/6; 340/579

[58] Field of Search ..... 431/25, 75, 76, 208, 431/37, 41; 236/15 E; 422/54; 340/579; 328/1, 6

[56] References Cited

U.S. PATENT DOCUMENTS

| | | | |
|---|---|---|---|
| 2,705,296 | 3/1955 | Weber | 431/15 |
| 3,879,667 | 4/1975 | Kraty et al. | 328/6 |
| 4,125,356 | 11/1978 | Ohashi et al. | 431/76 |

*Primary Examiner*—Lee E. Barrett

*Attorney, Agent, or Firm*—Sughrue, Mion, Zinn, Macpeak, and Seas

[57] ABSTRACT

A device for detecting the presence or absence of flame in a combustor and an oxygen density of room air used to operate the combustor. An ion current detecting sensor increases a flame ion current value in the combustor to an ion current value at which erroneous detection of the presence or absence of flame is prevented. A timer outputs a high level signal when combustion starts and starts a timer operation for holding the high level signal until the ion current is stabilized. Thereafter, the time outputs a low level signal which grounds a circuit to lower the flame presence or absence detecting ion current value detected by the sensor. A voltage comparator compares a flame presence or absence detecting ion-current developed voltage and a room air oxygen density detecting ion-current developed voltage with a predetermined reference voltage corresponding to a value at which both the presence or absence of flame and the oxygen density in the room can be detected to provide an output signal when the flame presence or absence detecting ion-current developed voltage or the room air oxygen density detecting iron-current developed voltage is larger than the reference voltage.

8 Claims, 11 Drawing Figures

DEVICE FOR DETECTING FLAME IN OPEN-TYPE COMBUSTOR AND OXYGEN DENSITY OF INDOOR AIR

BACKGROUND OF THE INVENTION

The present invention relates to a device for detecting the presence or absence of a flame in an open type combustor and the oxygen density of the air in the room where the combustor is operated by detecting the ion current of the flame in the combustor.

The oxygen density of the air in the room where a heating apparatus or a water heater with an open type combustor using indoor air for combustion is installed is an essential factor for safety and health. Therefore, it is necessary to detect the oxygen density of the air in such a room and to stop the combustor or to ventilate the room is necessary.

As shown in FIG. 1, the ion current value of a flame in an open type combustor decreases with the oxygen density of air in the room. Therefore, the oxygen density of air in the room can be detected by detecting the flame ion current. The flame ion current value is detected to determine whether flame is present therein or not to provide a detection signal which is used to control the operation of the combustor. Therefore, if the flame presence or absence detecting device provided in the combustor is used as a density detecting device to detect the amount of oxygen in the air in the room, then it is not necessary to provide such a separate oxygen density detecting device. That is, flame detection and oxygen density detection can be carried out with a single device resulting in a reduction in cost.

However, as shown in FIG. 2, the flame ion current value is greatly pulsive for period of time after combustion starts. Therefore, in order to avoid erroneous detection of the presence or absence of flames, it is necessary to increase the output level or an ion current detecting sensor in a flame presence or absence detecting device for the open type combustor. If the output level is increased, the ion current level, which is relatively stable after a certain time, is also increased. Thus, it has been impossible to use a flame presence or absence detecting device as a room air oxygen density detecting device. The reason for this will be described in detail with reference to FIG. 3.

If the sensitivity of the ion current detecting sensor is not increased, the characteristic of flame ion current with time is as indicated by the dotted line in FIG. 3. Therefore, if the value C is selected as a reference value for determining the presence or absence of flame, it may be determined that flame is absent although actually flame is present. In order to eliminate this drawback, the sensitivity of the ion current detecting sensor can be increased to provide a characteristic of ion current level with time as indicated by the solid line in FIG. 3. In this case, the presence or absence of flame can be positively determined with the reference value C mentioned above.

However, if the sensitivity of the ion current detecting sensor is increased, then the ion current level after the start of combustion is also increased, as described above. Thus, at the time instant $t_1$ when the oxygen density of the room air should be detected and when the oxygen density is sufficiently low as to present a health hazard, the ion current level does not decrease to the value C. The ion current level does not decrease to the value C until some time after the time instant $t_1$. For this reason, it has been impossible to use the flame presence or absence detecting device as a room oxygen density detecting device. Thus, different devices have heretofore been required for detecting the presence or absence of flame and the oxygen density of room air resulting in a high total cost.

SUMMARY OF THE INVENTION

An object of the invention is to eliminate the abovedescribed difficulties accompanying a conventional heating unit such as a heating apparatus or a water heater.

More specifically, an object of the invention is to provide a detecting device having a low manufacturing cost and which is capable of detecting both the presence or absence of flame in an open type combustor and the oxygen density of indoor air.

In accordance with these and other objects of the invention, there is provided a detecting device including an ion current detecting sensor for detecting a flame ion current, first means for increasing an ion current level detected by the ion current detecting sensor to a flame presence or absence detecting ion current level at which erroneous detection of the presence or absence of flame is eliminated, second means for correlating the flame presence or absence detecting ion current level provided by the first means to a room air oxygen density detecting ion current level a predetermined period of time after combustion starts, and third means operating in response to the flame presence or absence detecting ion current level and the room air oxygen density detecting ion current level to detect both the presence or absence of flame and the oxygen density of the room air and to provide a detection output, wherein both the presence or absence of flame and the oxygen density of the room air is detected with a single detecting device.

The foregoing object and other objects of the invention will become more apparent from the following detailed description and the appended claims when read in conjunction with the accompanying drawings.

BRIEF DESCRIPTION OF THE DRAWINGS

In the accompanying drawings:

FIGS. 4 through 6B show a heating apparatus to which a detecting device according to the invention is applied of which FIG. 4 is a sectional view showing the arrangement of the heating apparatus, FIG. 5 is an explanatory diagram showing the arrangement of an open type combustor used for the heating apparatus, FIG. 6B is a diagram showing a drive circuit for a second relay coil;

DESCRIPTION OF THE PREFERRED EMBODIMENTS

Figure 4:
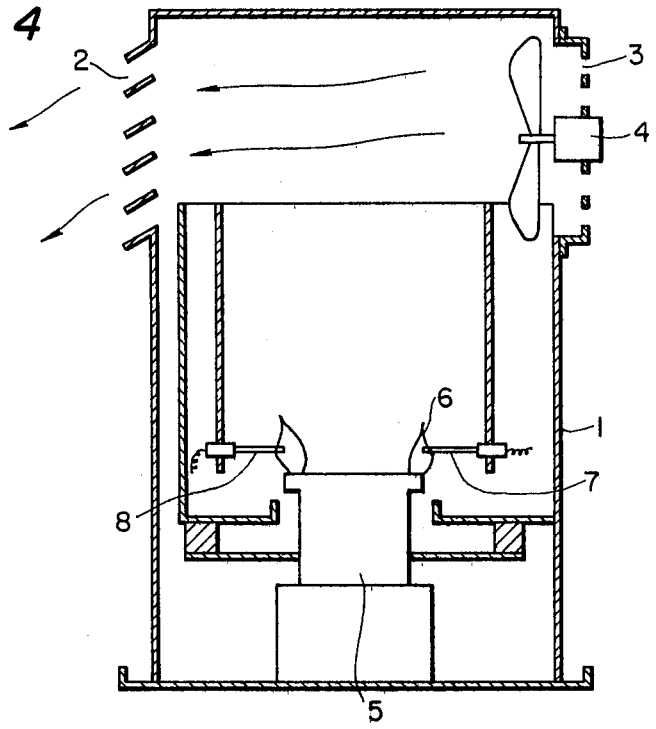
Figure 5:
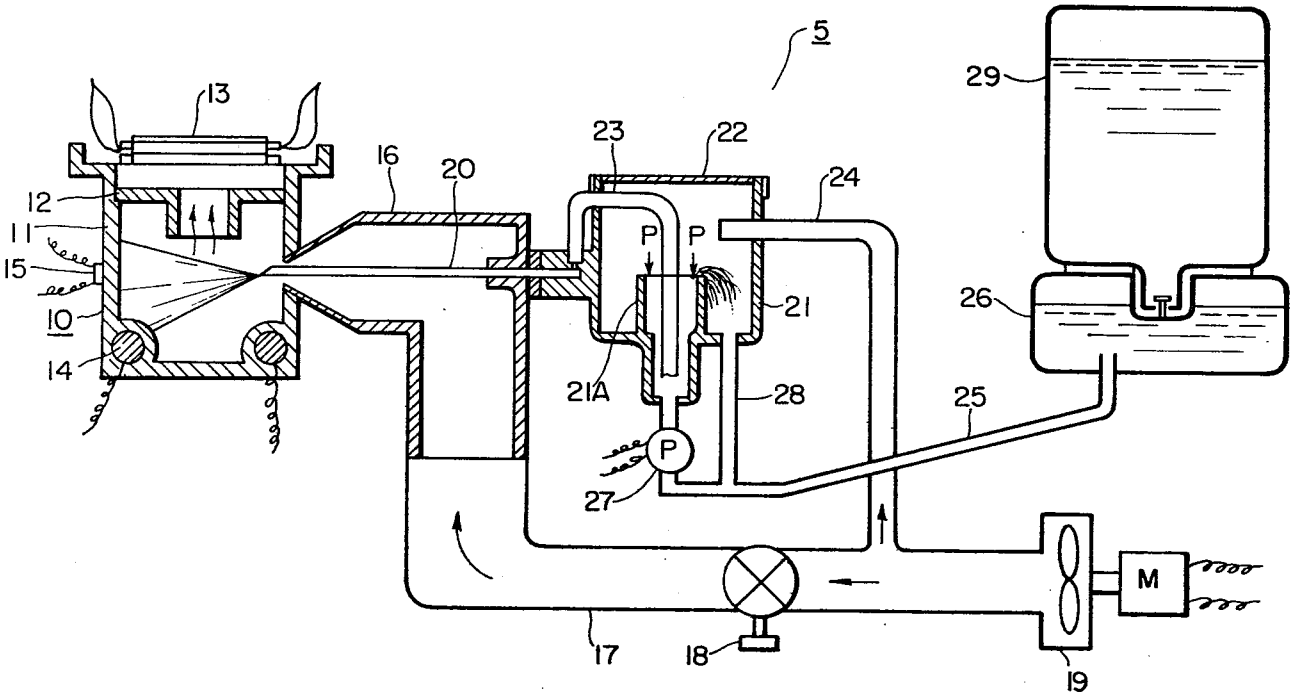

A preferred embodiment of a detecting device constructed according to the invention will be described which, by way of example, is applied to a heating apparatus with an open type combustor which has a construction and an electrical circuit as shown in FIGS. 4 through 6. The open type combustor uses room air for combustion.

First, the construction and the electrical circuit of the heating apparatus will be described. FIG. 4 is an explanatory diagram outlining the construction of the heating apparatus. In FIG. 4, reference numeral 1 designates an outer casing, 2 hot air blow-off openings formed in the upper portion of the front wall of the outer casing 1, 3 air suction holes formed in the upper portion of the rear wall of the outer casing 1, 4 a hot air blowing fan mounted in the region of the air suction holes 3, 5 the aforementioned combustor provided in the lower portion of the interior of the outer casing 1 with the combustor using room air for combustion (the construction of the combustor being briefly illustrated in FIG. 5), 6 flame formed in the combustor 5, 7 a flame rod for detecting a flame current, and 8 an ignition unit.

As described above, FIG. 5 is a schematic diagram showing the arrangement of the combustor 5. In FIG. 5, reference numeral 10 designates a burner, 11 a carburetor cylinder, 12 a throttle plate, 13 a burner head, and 14 a heater for heating the inner wall of the carburetor cylinder 12. The heater 14 is formed with a resistor having a positive temperature resistance characteristic, hereinafter referred to as "a PTC thermistor" when applicable. The heater 14 is buried circularly in the wall of the carburetor cylinder 11.

Further in FIG. 5, reference numeral 15 designates a temperature detecting element for detecting the temperature of the carburetor cylinder 11, the element 15 having contacts which close when the temperature of the wall of the carburetor cylinder 11 reaches about 250° C., 16 a nozzle coupled to the carburetor cylinder 11, 17 an air duct connected to the nozzle 16, 18 a control valve for controlling the flow rate of blowing air, 19 a burning air blower for blowing in room air for combustion, and 20 a needle provided coaxially in the straight portion of the nozzle 16. One end of the needle extends through the opening on the burner side of the nozzle into the carburetor cylinder 11 while the other end extends through the wall of the nozzle opposite to the aforementioned opening of the nozzle 16.

Further in FIG. 5, reference numeral 21 designates an oil leveler with a lid 22 and a substantially inverted U-shaped orifice tube which has one end extending into the fuel pool in the oil leveler and the other end connected to the needle 20, 24 a static pressure tube having one end extending into the oil leveler 21 and the other end connected to the air duct, 25 an oil supplying pipe having one end connected to the bottom of the oil leveler 21 and the other end connected to an auxiliary tank 26, 27 an oil supplying electromagnetic pump inserted in the oil supplying pipe 25, 28 a returning pipe connecting the bottom of the oil leveler 21 to the midpoint of the oil supplying pipe 25, and 29 a cartridge tank for containing liquid fuel.

Figure 1:
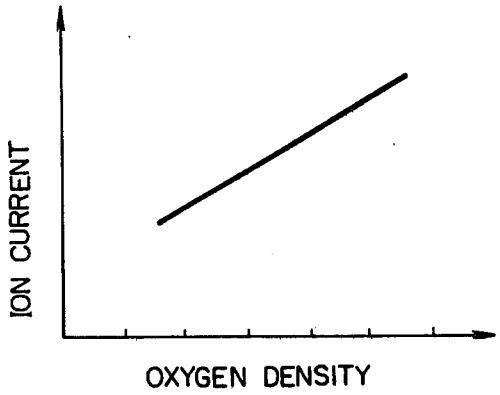
FIG. 1 is a graphical representation indicating a characteristic of flame ion current with oxygen density.
Figure 2:
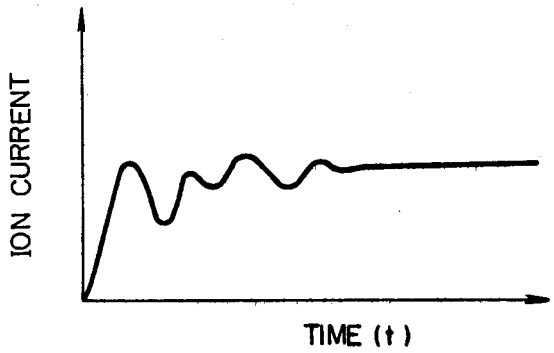
FIG. 2 is a graphical representation indicating a characteristic of flame ion current with time.
Figure 3:
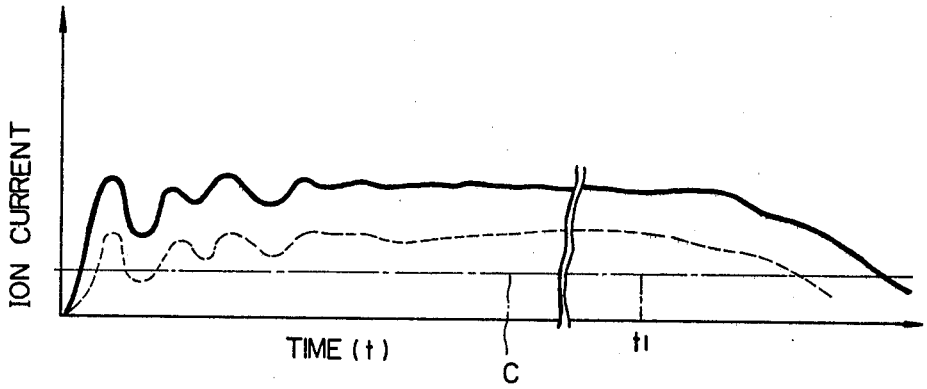
FIG. 3 is also a graphical representation indicating a characteristic of flame ion current with time in the case where an open type combustor is operated in a closed room.
Figure 6A:
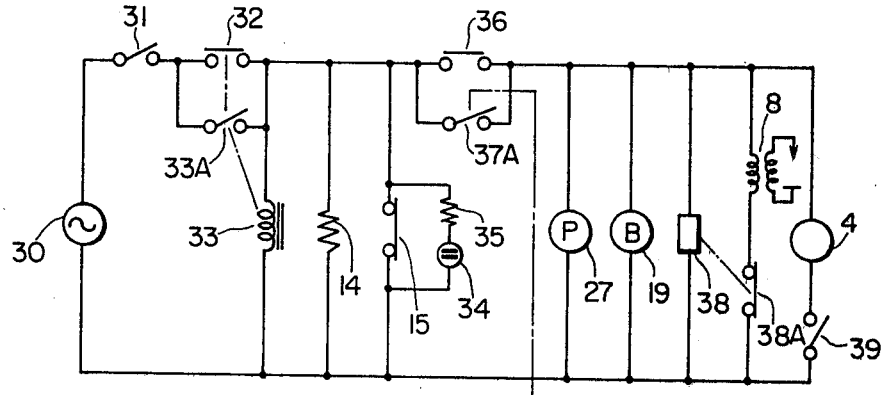
FIG. 6A is a circuit diagram showing an electrical circuit of the heating apparatus.

FIG. 6A is an electrical circuit of the heating apparatus thus constructed. In FIG. 6A, reference numeral 30 designates a commercial power source, 31 a main switch, 32 a first push-button type switch, 33 a first relay coil, 33A the normally open contact of the first relay coil 33 with the contact 33A being connected in parallel with the first push-button type switch 32, 14 the aforementioned heater, and 15 the aforementioned temperature detecting element.

Further in FIG. 6A, reference numeral 34 designates a lamp for indicating the completion of preheating of the carburetor cylinder 11, 35 a resistor with the lamp 34 and the resistor 35 being connected in parallel with the temperature detecting element 15, 36 a second push-button type switch, 37A the normally open contact of a second relay coil 37 which is driven by the device of the invention, 27 and 19 the aforementioned fuel supplying electromagnetic pump and combustion air blowing fan, respectively, 38 a timer element, 38A a normally closed contact of the timer element 38, 8 the aforementioned ignition unit, 4 the above-described hot air blowing fan, and 39 a normally open delay switch which is closed after combustion starts.

Figure 6B:
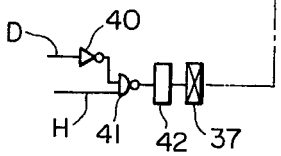

FIG. 6B shows a drive circuit for the second relay coil 37 which is driven by the device of the invention. In FIG. 6B, reference numeral 40 designates an inverter to which the output signal of the device of the invention is applied, 41 an AND circuit to one of the input terminals of which the output signal of the inverter 40 is applied, and 42 a driver to which the output signal of the AND circuit 41 is applied. In FIG. 6B, the power source for the circuitry is not shown.

The heating apparatus to which the device of the invention is applied is arranged as described above.

Figure 7:
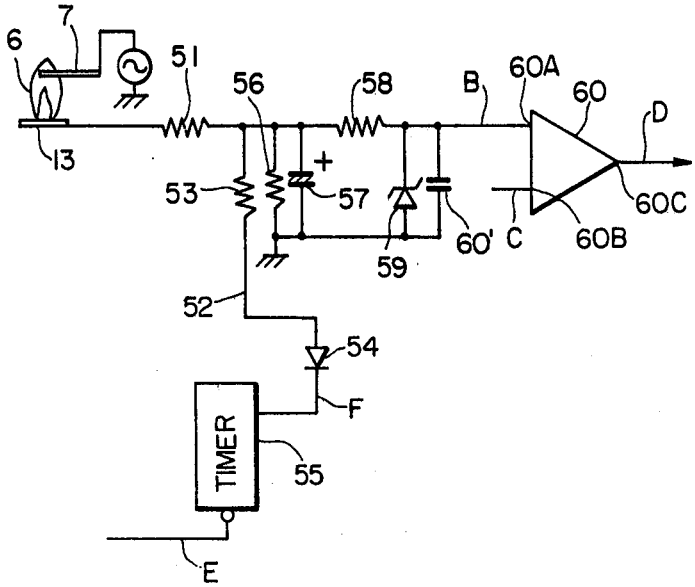
FIG. 7 is a circuit diagram showing an example of the detecting device according to the invention.
Figure 8:
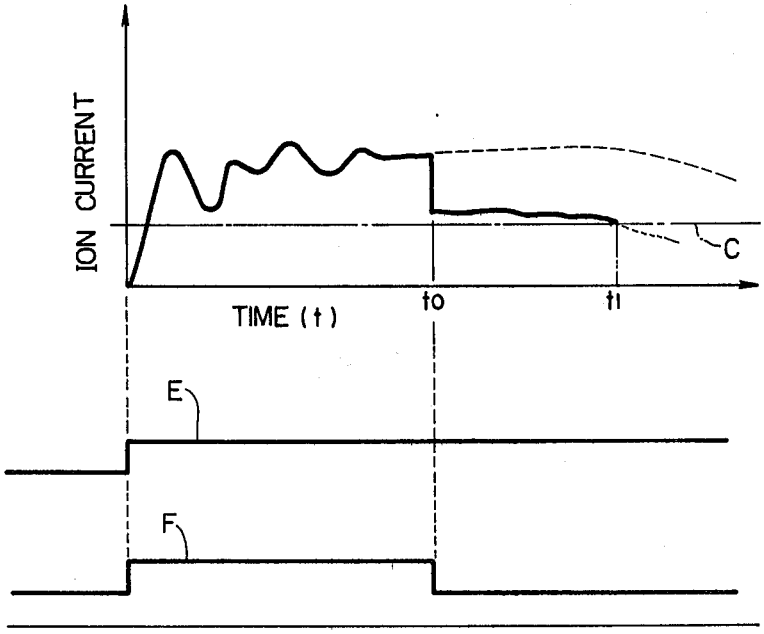
FIG. 8A is a graphical presentation indicating a characteristic of flame ion current level with time in the case where the heating apparatus is operated in a closed room.
FIGS. 8B and 8C are timing charts indicating a reset signal for a timer unit and an output signal of the timer unit, respectively.

FIG. 7 shows a specific example of a detecting device according to the invention, which is adapted to detect the presence or absence of flame and to detect the oxygen density of room air. FIG. 8 is a waveform diagram used to explain the operation of the invention. The upper waveform in FIG. 8 indicates ion current with time in the case where the above-described heating apparatus is operated in a closed room. In FIG. 8, reference character $t_0$ designates a time instant at which a flame presence or absence detected value is correlated to an room air oxygen density detected value during the period of time for which a flame ion current value is maintained relatively stable, $t_1$ is a time instant at which the room air oxygen density decreases to such a level as to be hazardous to health, and C is the reference voltage of a voltage comparator 60 (described below) with which the above-described flame presence or absence detected value and indoor air oxygen density detected value are compared.

Referring back to FIG. 7, reference numeral 7 designates the aforementioned flame rod serving as an ion current detecting sensor. Alternating current is applied across the flame rod 7 and the burner head 13 through the flame 6. The detection sensitivity of the flame rod 7 is increased to the extent that, in detection of the presence or absence of flame, no erroneous determination is made. That is, an increased flame presence or absence detecting ion current value is outputted to avoid erroneous determination. The reason why the detection sensitivity must be increased has been described above in the Background of the Invention.

Further in FIG. 7, reference numeral 51 designates a first resistor connected electrically to the burner head 13. Reference numeral 52 designates an ion-current developed voltage switching circuit constituted by a second resistor 53 connected to the first resistor 51, a diode 54 and a timer unit 55, the switching circuit 52 being adapted to switch an ion-current developed voltage applied to a first input terminal 60A of the voltage comparator 60 (described below).

When combustion starts, the reset signal E of the timer unit 55 is released, as shown in the center waveform of FIG. 8, at which time the timer 55 outputs a signal F at a high level as shown in the center waveform of FIG. 8, while the timer unit 55 is starting its timing operation. Thus, the circuit composed of the second resistor 53 and the diode 54 is maintained substantially released until the predetermined period of time $t_0$ has passed after the start of combustion, so that all the ion-current developed voltage detected by the flame rod 7 is applied to the first input terminal 60A of the voltage comparator 60. Thereafter, the level of the signal F is changed to a low level as indicated by the lower waveform of FIG. 8 so that the circuit composed of the second resistor 53 and the diode 54 is substantially connected to ground through the timer 55 thereby decreasing the ion-current developed voltage applied to the first input terminal 60A of the voltage comparator 60.

The voltage decreases to the extent that the oxygen density of the room air can also be accurately detected at the time instant $t_1$ indicated in the upper waveform of FIG. 8.

An M58479P type IC manufactured by Mitsubishi Electric Co., Ltd. of Japan may be employed for the timer unit 55.

Referring back to FIG. 7, reference numeral 56 designates a third resistor for converting an ion current into a voltage signal, 57 a smoothing capacitor connected in parallel with the third resistor 56 for smoothing the ripple component of the ion current (although the latter is rectified by the flame), 58 a protective resistor, 59 a Zener diode, and 60' a capacitor which acts together with the resistor 58 and the Zener diode 59 to protect the voltage comparator 60 from overvoltage.

The voltage comparator 60 is a conventional device having first and second input terminals 60A and 60B and an output terminal 60C. When an ion-current developed voltage applied to the first input terminal 60A is larger than the voltage applied to the second input terminal 60B, the voltage comparator 60 generates an output signal D, which is applied to the inverter 40 shown in FIG. 6C.

Applied to the first input terminal 60A of the voltage comparator 60 are an ion-current developed voltage with which the erroneous detection of the presence or absence of flame is avoided, that is, the presence or absence of flame can be satisfactorily detected before the time instant $t_0$, and an ion-current developed voltage with which the oxygen density of room air can also be detected after the time instant $t_0$.

Simultaneously with the start of combustion, the aforementioned reference voltage C is applied to the second input terminal 60B of the voltage comparator 60. The value of the reference voltage is determined by taking into account the ion-current developed voltage applied to the first input terminal so that erroneous detection of the presence or absence of flame during the initial period of combustion is avoided and the oxygen density of the room air is also detected at the time $t_1$ when the oxygen density of the indoor air decreases to such a level as to be hazardous to health.

The device of the invention is constructed as described above. The power source for the timer unit 55, the voltage comparator 60, etc. is not shown.

The operation of the device according to the invention will be described with reference to FIGS. 4 through 8. In FIG. 6, when the first push-button type switch 32 is turned on after the main switch 31 has been turned on, the first relay coil 33 is energized to close the normally open contact 33A which, due to the construction of the relay, remains closed even when current is removed from the relay coil 33. Therefore, even if the depression of the switch 32 is suspended thereafter, current is maintained applied to the heater 14, etc. Upon application of current to the heater 14, the inner wall of the carburetor cylinder 11 is heated thereby. When the temperature of the inner wall of the carburetor cylinder 11 is increased to about 250° C., the normally closed contact of the temperature detecting element 15 adapted to detect the temperature of the carburetor cylinder 11 is opened. As a result, current flows to the lamp 34 which indicates the completion of preheating of the carburetor cylinder 11, which had been short-circuited by the temperature detecting element 15.

In response to the turning-on of the lamp 34, the operator depresses the second push-button type switch 36. As a result, current is applied to the fuel supplying electromagnetic pump 27, the burning air blower 19, the timer element 38 and the ignition unit.

As the blower 19 is driven, room air is injected into the carburetor cylinder 11 through the air duct 17 and the nozzle 16. A part of the burning air is supplied into the oil leveler 21 through the air duct 17 and the static pressure tube 24. As the electromagnetic pump 27 is operated, the liquid fuel supplied into the auxiliary tank 26 from the tank 29 is supplied into the oil leveler 21 through the oil supplying pipe 25. The liquid fuel in the oil leveler 21 overflows when its level reaches the top of a partition 21A provided in the oil leveler 21 and returns to the oil supplying pipe 25 through the return pipe 28. The fuel thus returned is pumped by the electromagnetic pump 27. The amount of fuel consumed in combustion (described later) is complemented by supplying fuel from the tank 29. Thus, the level of fuel in the oil leveler is maintained unchanged.

In operation, air is delivered into the oil leveler 21 through the static pressure return tube 24 so that an air pressure P is applied to the surface of the liquid fuel. Accordingly, the liquid fuel is supplied through the orifice pipe 23 to the needle 20. The fuel supplied to the needle 20 is atomized by the shear force of the injected air. The fuel thus atomized enters the carburetor cylinder 11 while spreading conically where it is heated and gasified.

The mixutre of the fuel thus treated and the surrounding air is concentrated at the hole of the throttle plate 12 where the density of the mixture is made uniform. Then the mixture is jetted through the hole of the throttle plate 12. During this operation, current is applied to the ignition unit 8. The air-fuel mixture is ignited by the ignition unit 8 as a result of which flame 6 is formed in the combustor 5.

When combustion is started as described above, the delay switch 39 is closed to operate the hot air supplying blower 4. As a result, room air is sucked into the outer casing 1 through the air suction holes 3 and is heated by the flames 6. The air thus heated is blown into the room through the hot air blow-off openings 2 to heat the air in the room. When hot air starts to come out, the second push-button type switch 36 is released. If, in this case, the combustion is normal, the second relay 57 is operated such that the normally open contact 37A is open whereupon combustion can continue. Substantially simultaneously with the operation of the hot air supplying blower 4, the normally closed contact 38A of the timer element 38 opens to interrupt the application of current to the ignition unit 8.

During combustion, the inner wall of the carburetor cylinder 11 is kept warm by combustion heat and is maintained at a predetermined temperature even though it is not heated by the heater 14. In this state, the resistance of the heater 14 formed with a PTC thermistor is increased thereby reducing the current flowing therein so that no heat is generated by the heater 14. Thus, the inner wall of the carburetor cylinder 11 is maintained at a predetermined temperature, for instance, about 250° C.

The heating of the room can be stopped by opening the main switch 31.

Next, the operation of the device according to the invention will be described. When the gas mixture is not ignited by the ignition unit 8, no ion current is provided. Therefore, no ion-current develoed voltage is applied to the first input terminal 60A of the voltage comparator 60. Accordingly, the voltage of the first input terminal 60A is lower than the reference voltage, and hence no output signal D is provided at the output terminal 60C. Therefore, the second relay coil 37 is not driven. Thus, if the second push-button switch 36 is then released, no current will be supplied to the pump 27 and the blower 19.

If the gas mixture is ignited, simultaneously the reset signal E of the timer unit 55 is released and the timer unit 55 provides the high level signal F as shown in the lower waveform of FIG. 8, thereby to substantially release the circuit composed of the second resistor 53 and the diode 54. As a result, all the ion-current developed voltage B detected by the flame rod 7 is applied to the first input terminal 60A of the voltage comparator 60. In this operation, the reference voltage C is applied to the second input terminal 60B of the voltage comparator 60. As the relationship between the reference voltage C and the voltage B is as indicated by the upper waveform of FIG. 8, the voltage B is higher than the reference voltage C. Therefore, the output signal D is provided at the output terminal 60C of the voltage comparator 60.

The output signal D is applied through the inverter 40 to one input terminal of the AND gate 41. As the input signal has been applied to the other input terminal of the AND circuit 41, the AND circuit 41 produces an output signal. The output signal of the AND circuit 41 is applied to the driver 42 so that the second relay coil 37 is operated to close its normally open contact 37A. Therefore, even if the second push-button type switch 36 is released, combustion is continued.

If, under the combustion condition, the flame goes out for some reason, the circuit condition becomes similar to that in the case where the mixture is not ignited. Therefore, the application of current to the elements in the rear stage of the second push-button type switch 36 is suspended. Thus, the presence or absence of flame is detected.

In detection the presence or absence of flame during the period in which the ion current is unstable, the ion current detection sensitivity of the flame rod 7 is increased while the ion-current developed voltage switching circuit 52 is maintained substantially released. Therefore, the ion-current developed voltage B applied to the voltage comparator 60 during the period that the ion current is unstable is higher than the reference voltage C. Accordingly, erroneous detection of the presence or absence of flame is eliminated. Even after the period is reached when the ion current is unstable, no erroneous detection of the presence or absence of flames is carried out for the same reason.

Next, the operation of detecting the oxygen density of indoor air will be described. As described above, if the heating apparatus is operated in a closed room, the oxygen density of the air in the room will decrease. That is, the use of the heating apparatus in a closed room can be hazardous to health. Accordingly, it is necessary in such an installation to detect the oxygen density of the air in the room and to stop combustion before the oxygen density reaches a hazardous level. Furthermore, in order to avoid the erroneous detection of the presence or absence of flame, the ion-current developed voltage B applied to the voltage comparator 60 during the period that the ion current is unstable is made higher than the reference voltage C. Accordingly, at the time instant $t_1$ when the oxygen density of the air in the room reaches the hazardous level, the oxygen density cannot be detected with the flame presence or absence detecting ion-current developed voltage B.

Therefore, in accordance with the invention, simultaneously with the start of combustion, the timer unit 55 starts a time counting operation and outputs the high level signal F. When the predetermined period of time $t_0$ which elapses before the flame ion current stabilizes has passed, the high level signal F is changed to the low level signal as shown in the lower waveform of FIG. 8 so that the ion-current developed voltage switching circuit is substantially short-circuited, and the ion-current developed voltage B applied to the first input terminal of the voltage comparator 60 is lowered after the lapse of the period of time $t_0$. In other words, the purpose of this operation is to apply to the first input terminal of the voltage comparator 60 an ion-current developed voltage B with which, at the time instant $t_1$ that the oxygen density of the air in the room reaches the hazardous level, the oxygen density is detected to stop the combustor. Thus, at the time instant $t_1$, the ion-current developed voltage B applied to the first input terminal of the voltage comparator 60 is lower than the reference voltage C, and no output signal D is provided at the output terminal 60C of the voltage comparator.

As a result, as described with reference to the operation of detecting the presence or absence of flame, the normally open contact 37A of the second relay coil 37 is opened to suspend the application of current to the circuit elements in the rear stage of the second push-button type switch 36, as a result of which the combustion is stopped. Accordingly, the health hazard is eliminated.

The oxygen density of the air in the room is detected as described above. It goes without saying that the presence or absence of flame is detected while the oxygen density is detected.

In the above-described embodiment of the invention, the output signal D is used to stop the pump 27, the blower 19, etc. required for combustion. However, the output signal D may be utilized to turn on a warning lamp as a warning signal to the user before the combustion is stopped. A variety of methods of utilizing the output signal D may be used. The same can be applied to the operation of detection of the presence or absence of flame.

A preferred embodiment has been described with reference to a case where the device of the invention is applied to a heating apparatus used indoors. However, it is evident that the device of the invention is applicable, for instance, to a water heater with an open type combustor using room air for combustion. Moreover, the invention is applicable not only to a heating apparatus using liquid fuel but also to one using gas fuel.

As is apparent from the above description, the device for detecting the presence or absence of flame in an open type combustor and the oxygen density of the air in the room of the invention includes the ion current detecting sensor (7, 13) for detecting the ion current of flame in the combustor, (51, 56) for producing a detection output signal in response to the ion current value detected by the sensor with a scale factor with respect to the detected ion current value such that no erroneous detection of the presence or absence of flame is caused, means (55) for changing the scale factor a predetermined period of time after the combustion starts to a value suitable for detecting an indoor air oxygen density, and means (60) operating in response to the detection output signal to detect both the presence or absence of flame and the indoor air oxygen density. Thus, with simple circuitry, the presence or absence of flame and the oxygen density of air in the room can be detected. The device of the invention which can detect both the presence or absence of flame in the combustor and the oxygen density of room air can be manufactured at low cost.

According to the invention, the first means for increasing the ion current level detected by the ion current detecting sensor to the flame presence or absence detected ion current value with which the erroneous detection of the presence or absence of flame is prevented acts by increasing the ion current detecting sensitivity of the ion current detecting sensor. Therefore, the provision of an additional amplifier is unnecessary.

Furthermore, according to the invention, the flame presence or absence detecting ion current value is correlated to the room air oxygen density detecting ion current at the time instant that the flame ion current is stabilized. Therefore, erroneous detection of the presence or absence of flame can be positively prevented.

In addition, the second means for correlating the flame presence or absence detecting ion current value provided by the first means to the indoor air oxygen density detecting ion current value the predetermined period of time after the combustion starts includes the circuit including the resistor which is connected between the first and third means and means for substantially releasing the circuit for a predetermined period of time after the combustion starts and for substantially short-circuiting the circuit thereafter. With this basis the device of the invention can be readily constructed merely by adding the second means to the conventional flame presence or absence detecting means.

What is claimed is:

1. A device for detecting both the presence or absence of flame in a combustor and an oxygen density of room air feeding said combustor, comprising:

a reference source for applying a reference signal across a portion of said flame;

an ion current detecting sensor for detecting an ion current in said flame produced as a result of said reference signal;

means for producing a detection output signal in response to an ion current detected by said sensor with a scale factor with respect to said detected ion current such that no erroneous detection of the presence or absence of flame occurs;

means for changing said scale factor a predetermined period of time after start of combustion of said flame to a value suitable for detecting an indoor oxygen density; and means operating in response to said detection output signal for comparing said detection output signal with a fixed reference value for producing a final output signal sequentially indicative of the presence or absence of flame and said oxygen density.

2. The device as claimed in claim 1, wherein said predetermined period of time is sufficiently long for said ion current to stabilize.

3. The device as claimed in claim 1, wherein said ion current detecting sensor comprises first and second resistors connected in series for voltage dividing a voltage produced across said flame by said ion current, said detection output signal being produced across said second resistor.

4. The device as claimed in claim 3, wherein said means for changing said scale factor comprises a third resistor and means for connecting said third resistor in parallel with said second resistor said predetermined period of time after start of combustion.

5. The device as claimed in claim 4, wherein said connecting means comprises timer means, said third resistor being connected between an output of said timer means and a junction point between said first and second resistors, said timer means outputting a high level signal for a period of time from a start of combustion until said predetermined period of time has passed and thereafter outputting a low level signal to connect said output of said timer to a ground level.

6. A device for detecting both the presence or absence of flame in a combustor and an oxygen density of room air upon which said combustor feeds, comprising:

an A.C. potential source;

a flame rod connected to a first terminal of said A.C. source;

a first resistor having a first terminal coupled to a burner head of said combustor for receiving an ion current made to flow through said flame by said A.C. source;

a second resistor coupled between a second terminal of said first resistor and a second terminal of said A.C. source;

a timer triggered to start a timing operation at a time of start of combustion of said flame for producing at an output terminal of said timer a signal in a high logic state during said timing operation and a signal in a low logic state thereafter;

a third resistor coupled between said second terminal of first resistor and said output terminal of said timer; and a comparator having a first input terminal coupled to said second terminal of said first resistor and a second input terminal coupled to a fixed reference voltage source, wherein a resistance ratio of said said first resistor to said second resistor is such that, during said timing operation, no erroneous detection of presence or absence of flame occurs, and a ratio of said second resistor to said third resistor is such that, after said timing operation, a voltage produced across said second resistor is suitable for detection of said oxygen density.

7. The device as claimed in claim 6, further comprising a smoothing capacitor coupled across said second resistor.

8. The device as claimed in claim 7, further comprising overvoltage protecting circuit means including a fourth resistor interposed between said second terminal of said first resistor and said first input terminal of said comparator, a Zener diode coupled between said first input terminal of said comparator and said second terminal of said A.C. source, and a second capacitor coupled across said Zener diode.

* * * * *